United States Patent [19]

Perez et al.

[11] 4,355,886

[45] Oct. 26, 1982

[54] POLYVINYL ACETAL COATED CARRIER PARTICLES FOR MAGNETIC BRUSH CLEANING

[75] Inventors: Steven R. Perez, Pittsford, N.Y.; Philip G. Horton, Greenville, S.C.; Jan M. Wlochowski, Pittsford, N.Y.

[73] Assignee: Xerox Corporation, Stamford, Conn.

[21] Appl. No.: 149,379

[22] Filed: May 13, 1980

[51] Int. Cl.[3] ..... G03G 21/00

[52] U.S. Cl. ..... 355/15; 430/108

[58] Field of Search ..... 355/15; 430/108, 125

[56] References Cited

U.S. PATENT DOCUMENTS

| | | | |
|---|---|---|---|
| 2,911,330 | 11/1959 | Clark . | |
| 3,507,686 | 4/1970 | Hagenbach | 430/108 |
| 3,918,808 | 11/1975 | Narita | 355/15 |
| 4,006,987 | 2/1977 | Tomono et al. | 355/15 |
| 4,116,555 | 9/1978 | Young et al. | 355/15 |
| 4,125,667 | 11/1978 | Jones | 430/108 X |
| 4,127,327 | 11/1978 | Rezanka | 355/15 |
| 4,272,184 | 6/1981 | Rezanka | 355/15 |
| 4,279,499 | 7/1981 | Rezanka et al. | 355/15 |

FOREIGN PATENT DOCUMENTS

| | | | |
|---|---|---|---|
| 55-135857 | 10/1980 | Japan | 430/108 |

*Primary Examiner*—G. Z. Rubinson
*Assistant Examiner*—Keith E. George
*Attorney, Agent, or Firm*—E. O. Palazzo

[57] ABSTRACT

An electrostatographic development and cleaning system employing electrically insulating carrier particles. The carrier particles comprise a core having magnetic or magnetically-attractable properties which is coated with a polyvinyl acetal. The coated carrier particles have negative triboelectric charging properties and are particularly useful in development systems employing negatively charged photoconductive surfaces. The carrier particles provide efficient removal of residual toner deposits from a photoreceptor surface after a copying operation.

10 Claims, 2 Drawing Figures

POLYVINYL ACETAL COATED CARRIER PARTICLES FOR MAGNETIC BRUSH CLEANING

This invention relates to electrostatographic imaging systems and, more specifically, to magnetic brush development and cleaning systems which employ insulating carrier particles.

In a conventional electrostatographic printing process of the type described in Carlson's U.S. No. 2,297,691, a uniformly charged imaging surface is selectively discharged in an image configuration to provide an electrostatic latent image which is then developed through the application of a finely divided coloring material called "toner". As is known, that process may be carried out in either a transfer mode or a non-transfer mode. In the non-transfer mode, the imaging surface serves as the ultimate support for the printed image. In contrast, the transfer mode involves the additional steps of transferring the developed or toned image to a suitable substrate, such as a plain paper, and then preparing the imaging surface for re-use by removing any residual toner particles still adhering thereto.

As indicated, after the developed image has been transferred to a substrate, some residual toner usually remains on the imaging surface. The removal of all or substantially all of such residual toner is important to high copy quality since unremoved toner may appear in the background in the next copying cycle. The removal of the residual toner remaining on the imaging surface after the transfer operation is carried out in a cleaning operation.

In present day commercial automatic copying and duplicating machines, the electrostatographic imaging surface, which may be in the form of a drum or belt, moves at high rates of speed in timed unison relative to a plurality of processing stations around the drum or belt. This raid movement of the electrostatographic imaging surface has required vast amounts of toner to be used during the development period. Thus, to produce high quality copies, a very efficient background toner removal apparatus or imaging surface cleaning system is necessary. Convention cleaning systems have not been entirely satisfactory in this respect. Most of the known cleaning systems usually becme less efficient as they become contaminated with toner thus necessitating frequent service of the cleaning system. As a result, valuable time is lost during "down time" while a change is being made. Also, the service cost of the cleaning system increases the per copy cost in such an apparatus. Other disadvantages with conventional "web" type, "foam" roll, "blade", or the "brush" type cleaning apparatus are known to the art.

One of the preferred vehicles for delivering the toner needed for development purposes is a multi-component developer comprising a mixture of toner particles and generally larger carrier particles. Normally, advantage is taken of the triboelectric charging process to induce electrical charges of opposite polarities onto the toner and carrier particles. To that end, the materials for the toner and carrier components of the developer are customarily selected so that they are removed from each other in the triboelectric series . Furthermore, in making those selections, consideration is given to the relative triboelectric ranking of the materials in order to ensure that the polarity of the charge normally imparted to the toner particles opposes the polarity of the latent images of interest. Consequently, in operation, there are competing electrostatic forces acting on the toner particles of such a developer. Specifically, there are forces which tend to at least initially attract the toner particles to the carrier particles. Additionally, the toner particles are subject to being electrostatically stripped from the carrier particles whenever they are brought into the immediate proximity of or make actual contact with an imaging surface bearing a charged latent image.

It has also been found that toner-starved carrier particles (i.e., carrier particles which are substantially free of toner) may be employed in cleaning systems to remove or other adhering toner particles from an imaging surface. To enhance that type of cleaning, provision is desirably made for treating the unwanted toner particles with a pre-cleaning corona discharge which at least partially neutralizes the electrical charges which give rise to the forces holding them on the imaging surface, and then the carrier particles are brought into contact with the imaging surface to collect the toner particles.

Heretofore, problems have been encountered in attempting to use electrically insulating carrier particles in systems relying on locally generated electrostatic fields. In particular, experience has demonstrated that poorly insulating carrier particles occasionally cause short circuits which are transitory (typically, having a duration of less than about 50 microseconds), but nevertheless troublesome inasmuch as they upset the electric fields. Proposals have been made to alleviate some of the problems, but the art is still seeking a complete solution. For example, it has been suggested that the development electrode and housing of a developent system should be maintained at the same potential, thereby preventing any current flow therebetween even should electrically insulating carrier particles bridge the intervening space. However, that suggestion does not solve the problem which arises when there is a pin hole or other defect in the insulating imaging surface which permits a bridge-like accumulation particles to establish a short circuit between the electrode and the conductive back for the imaging surface.

Understandably, therefore, poorly electrically insulating carrier particles are not generally favored. This is especially so for use in a magnetic brush device for removing residual toner particles from an imaging surface because carrier particles suitable for this purpose must typically withstands high electrical fields across close spacings without suffering electrical breakdown through short-circuits. In addition, the coating material employed on the carrier particles must be able to generate a strong triboelectric potential when coming in contact with toner particles as to electrostatically attract and remove them from a charged imaging surface.

PRIOR ART STATEMENT

A number of patents disclose magnetic brush cleaning systems. See e.g., U.S. Pat. Nos. 2,911,330; 3,580,673; 3,700,328; 3,713,736; 3,918,808; 4,006,987; 4,116,555; and 4,127,327. Briefly, in each of these patents there is disclosed a magnetic brush cleaning system in which a magnetic roller is mounted for rotation and located adjacent to the area of the photoreceptor surface to be cleaned. A quality of magnetic carrier beads or particles are in contact with the magnetic roller and are formed into streamers or brush configuration. The magnetic roller supporting the brush may be connected to a source of DC potential to exert electrostatic attraction on the residual toner image to be cleaned. Thus, the magnetic brush removes toner from the imaging surface by mechanical, electrostatic, and triboelectric forces.

In the magnetic brush cleaning devices of the prior art, the magnetic brush may be located either above the photoreceptor surface to be cleaned or it may be located elevationally at or below the photoreceptor. Compare FIGS. 1 and 2 of U.S. Pat. No. 2,911,330. When the magnetic brush is located elevationally at or below the photoreceptor surface area to be cleaned, a reservoir or sump for holding a suppoy of the magnetic carrier particles may be provided for the formation of the magnetic brush. The relatively large supply of carrier particles in the reservoir permits long operation before the carrier particles are substantially saturated with toner particles and can no longer efficiently clean the photoreceptor surface area.

Accordingly, it is an object of this invention to provide a development and cleaning system which overcomes the above-noted deficiencies.

It is another object of this invention to provide a magnetic brush cleaning system which enables efficient cleaning of an imaging surface for extended periods of time between service calls.

It is another object of this invention to provide carrier particles having superior electrically insulating characteristics and which do not cause photoreceptor shorting problems.

It is a further object of this invention to provide carrier particles which may be employed with a magnetic brush cleaning system and enable efficient removal of residual toner deposits from photoreceptor surfaces.

It is still a further object of this invention to provide improved developer materials which may be employed in electrostatographic development and cleaning of negatively charged photoreceptor surfaces.

It is another object of this invention to provide electrostatographic cleaner and developer materials having physical and electrostatographic properties superior to those of known cleaner and developer materials.

The above objects, and others, are accomplished, generally speaking, by providing a magnetic brush cleaning system employing polymer coated magnetic or magnetically-attractable carrier particles having electrically insulating properties. More particularly, the carrier particles employed in the magnetic brush cleaning system of this invention comprise magnetic and/or magnetically-attractable carrier core particles having an average diameter of from between about 30 microns and about 1,000 microns with a coating comprising a polyvinyl acetal. The polyvinyl acetal coating material may be selected from the group of polyvinyl acetals prepared from aldehydes and vinyl alcohols. Typical polyvinyl acetals include polyvinyl butyral and polyvinyl formal such as those which are commercially available from Monsanto Plastics and Resins, St. Louis, Missouri under the tradenames Butvar and Formvar, respectively. The thus coated carrier particles may also be mixed with finely-divided toner particles to form electrostatographic developer mixtures wherein the toner particles electrostatically cling to the carrier particles. The resultant developer mixtures are preferably employed in an electrostatographic development system where development of a negatively charged photoreceptor is desired. In accordance with this invention, it has been found that the carrier coating materials of this invention provide electrostatographic coated carrier materials which possess desirable negative triboelectric charging properties, excellent copy print quality, life performance characteristics superior to known negatively charging coated carrier particles such as carrier particles coated with halogenated polymers and electrically insulating properties such as to withstand high electrical fields across a nominal spacing in the cleaning device.

Although not wishing to be bound by an explanation therefor, it is believed that the improved life performance characteristics of the carrier compositions of this invention are due to the outstanding adhesion, film forming, and electrically insulating properties of the coating materials. Such improved life performance characteristics of the carrier materials are especially notable when these polyvinyl acetals are aplied to metallic carrier cores, since typically, halogenated resins applied to metallic carrier cores are unstable as evidenced by short carrier life. In addition, the coating compositions of this invention have been found to provide an especially desirable and useful range of triboelectric charging properties to the carrier materials when employed for the cleaning of imaging surfaces bearing negative charges. Further, the negative triboelectric charging values of these polyvinyl acetal coated carrier particles is completely unexpected when they are contacted with finely-divided toner particle compositions containing triboelectric charge control additives and result in improved performance in the development and cleaning of negatively charged electrostatic latent images.

The features of the present invention will become more apparent as the following description proceeds and upon reference to the drawing in which.

Figure 1:
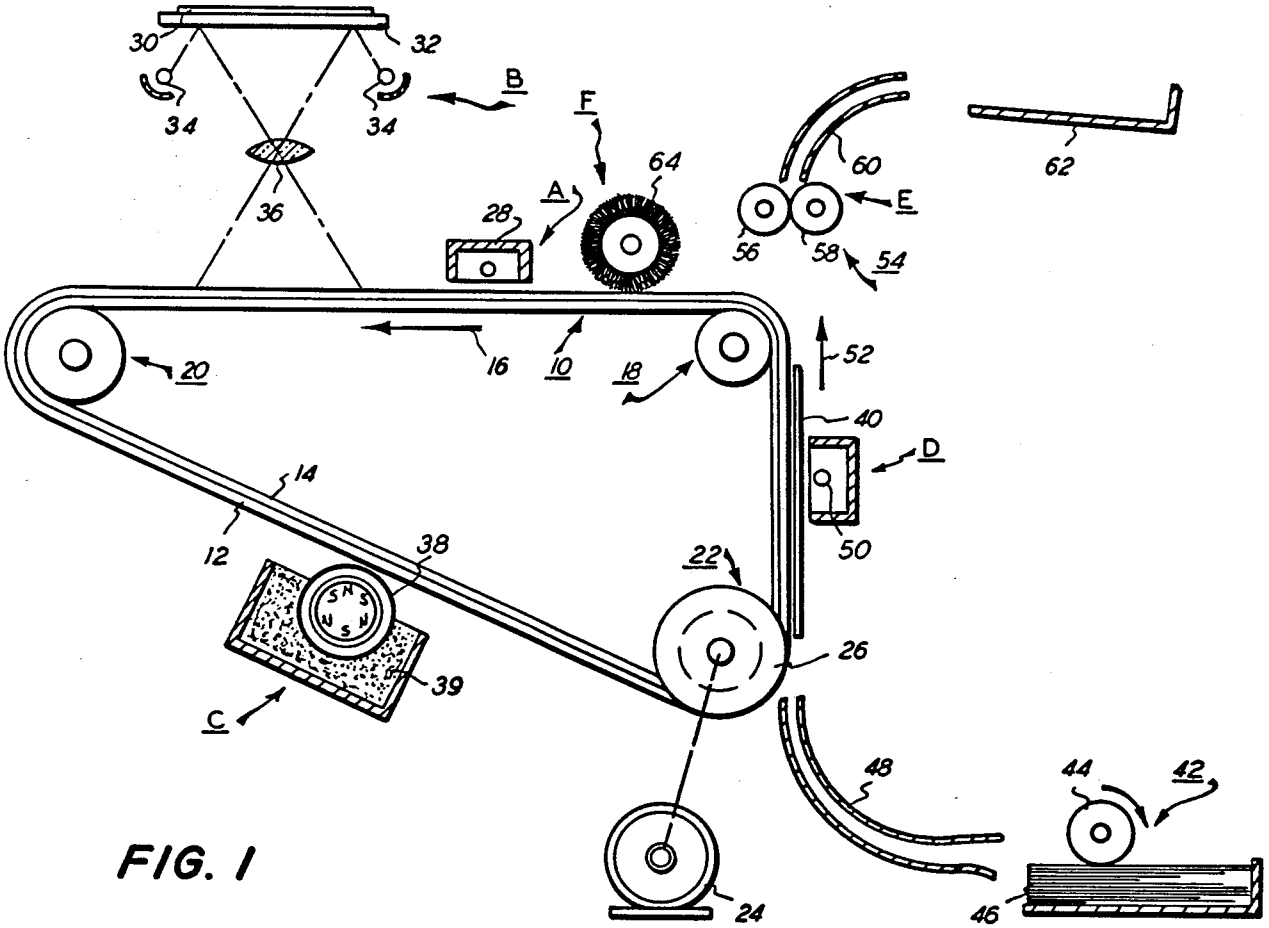
FIG. 1 is a schematic elevational view depicting an electrophotograhic printing machine incorporating the elements of the present invention therein. Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a flexible belt 10 having a photoconductive surface 12 deposited on a conductive substrate 14. Belt 10 moves in the direction of arrow 16 to advance successive portions of photoconductive surface 12 sequentially through the various processing stations disposed about the path of movement thereof. Belt 10 is entrained about stripping roller 18, tension roller 20, and drive roller 22.

Drive roller 22 is mounted rotatably and in engagement with belt 10. Motor 24 rotates roller 22 to advance belt 10 in the direction of arrow 16. Roller 22 is coupled to motor 24 by suitable means such as a belt drive. Drive roller 22 includes a pair of opposed, spaced flanges or edge guides 26. Edge guides 26 are mounted on opposed ends of drive roller 22 defining a space therebetween which determines the desired predetermined path of movement for belt 10. Edge guides 26 extend in an upwardly direction from the surface of roller 22. Preferably, edge guides 26 are circular members or flanges.

Belt 10 is maintained in tension by a pair of springs (not shown) resiliently urging tension roller 22 against belt 10 with the desired spring force. both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges photoconductive surface 12 of belt 10 to a relatively high, substantially uniform potential. A suitable corona generating device is described in U.S. Pat. No. 2,836, 725 issued to Vyveberg in 1958.

Next, the charged portion of photoconductive surface 12 is advanced through exposure station B. At exposure station B, an original document 30 is positioned face down upon transparent platen 32. Lamps 34 flash light rays onto original document 30. The light rays reflected from original document 30 are transmitted through lens 36 forming a light range thereof. The light image is projected onto the charged portion of photoconductive surface 12 to selectively dissipate the charge thereon. This records an electrostatic latent image on photoconductive surface 12 which corresponds to the informational areas contained within original document 30.

Therefore, belt 10 advances the electrostatic latent image recorded on photoconductive surface 12 to development station C. At development station C, a magnetic brush developer roller 38 advances a developer mix 39 into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material 40 is moved into contact with toner powder image. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the uppermost sheet from stack 46 into chute 48. Chute 48 directs the advancing sheet of support material into contact with the photoconductive surface 12 of belt 10 in a timed sequence so that the toner powder image developed thereon contacts the advancing sheet of support material at transfer station D.

Transfer station D includes a corona generating device 50 which sprays ions onto the backside of sheet 40. This attracts the toner powder image from photoconductive surface 12 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder image to sheet 40. Preferably, fuser assembly 54 includes a heated fuser roller 56 and a back-up roller 58. Sheet 40 passes between fuser roller 56 and back-up roller 58 with the toner powder image contacting fuser roller 56. In this manner, the toner powder image is permanently affixed to sheet 40. After fusing, chute 60 guides the advancing sheet 40 to catch tray 62 for removal from the printing machine by the operator.

Invariably after the sheet of support material is separated from photoconductive surface 12 of belt 10, some residual particles remain adhering thereto. These residual particles are removed from photoconductive surface 12 at cleaning station F. Cleaning station F includes a rotatably mounted magnetic cleaning brush 64 in contact with photoconductive surface 12. The particles are cleaned from photoconductive surface 12 by the counter-rotation of brush 64 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine.

Figure 2:
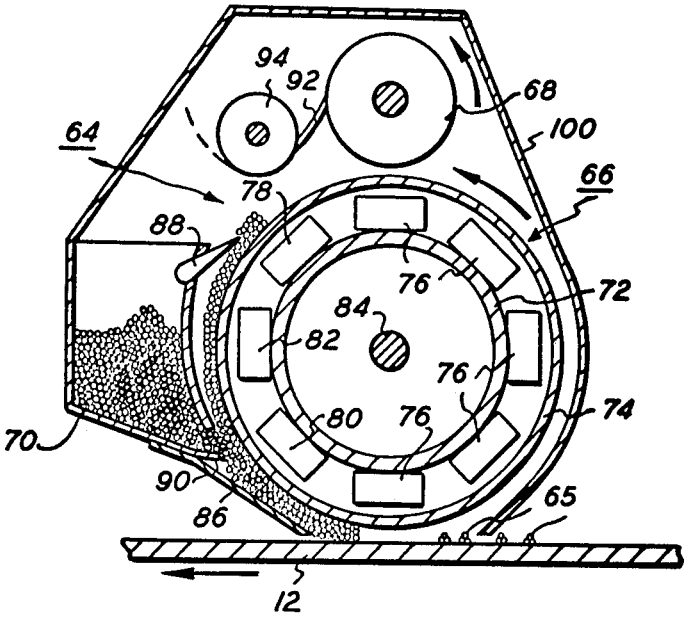
FIG. 2 is a schematic illustration detailing a cleaning brush employed in a magnetic brush imaging system, and the cleaning of residual toner particles from an imaging surface utilizing insulating carrier particles.

Referring now to the specific subject matter of the present invention, FIG. 2 deicts cleaning brush 64 in greater detail. The magnetic brush cleaning system comprises a magnetic brush roll having a plurality of magnet means mounted therein and a reservoir for the cleaning carrier particles of this invention closely spaced from the magnetic brush roll. In FIG. 2, the magnetic brush cleaning apparatus 64 is shown to be located above the photoreceptor surface 12 which is to be cleaned. The photoreceptor 12 has residual toner image areas 65 which must be cleaned before the photoreceptor can be used over again in the next copying cycle. The magnetic brush cleaning apparatus 64 is made of a brush roll 66, detoning roll 68 and a reservoir or sump 70 for the carrier beads.

The brush roll 66 is made of an inner sleeve or support 72 and an outer shell 74. The inner sleeve, which may conveniently be made of such ferro-magnetic materials as cold rolled steel has a number of magnets 76 fixedly mounted on its outer surface. In addition to magnets 76, there are provided a trim magnet 78, a sump exit magnet 80, and a sump magnet 82. The number of magnets mounted on the outside of sleeve 72 may be varied, but the total should be an even number such as six or eight or ten to facilitate the even distribution of the magnetic lines of force. Although the magnets 76 are shown to be separate magnets mounted on the outside of sleeve 72, it will be appreciated that a single magnetizable piece of material, sections of which may be alternately magnetized, may be used. The entire inner sleeve structure is mounted so as to be stationary during the operation of the magnetic brush cleaning apparatus.

The outer shell 74 is preferably concentric to the inner sleeve 72. Outer shell 74 is rotatably mounted on a shaft 84. On the exterior surface of the shell 74, cleaning brush fibers or streamers 86 are formed of carrier particles of this invention.

The reservoir 70 for the carrier particles preferably has a pickoff means 88 and exit means 90 associated therewith. Pickoff means 88, which in its simplest form may be doctor blade or scraper knife, may be integral with the reservoir 70 or it may be a separately formed member attached to the reservoir for convenient adjustment. Exit means 90 may conveniently be an opening at the bottom of the reservoir 70 with a baffle extending to a predetermined position.

Detoning roll 68 removes toner from the magnetic brush fibers 86 by contact therewith. A scraper 92 removes the toner from the detoning roll 68 for disposal by transporting means 94.

Around the entire outside perimeter of the magnetic brush cleaning apparatus a shield 100 is provided to contain any stray carrier particles which may separate from the outer shell 74 due to the action of stationary magnetic lines of force on the rotating magnetic brush or streamers 86.

When it is desired to load the electrically insulating carrier particles into the magnetic brush cleaning apparatus, a loading door located above the cylinder may be removed and the carrier particles loaded into the apparatus. When the carrier particles are spent, such as due to toner impaction, and it is desired to remove or unload them from the cleaning apparatus, an unloading door is provided in the bottom of the cleaning apparatus housing. This door arrangement provides for easy maintenance of the cleaning apparatus.

The brush roll 66 is generally biased with an appropriate source of DC potential, not shown, to assist the removal of the residual toner image 65 from the photoreceptor 12. Similarly, the detoning roll 68 is negatively biased to exert electrostatic attraction on the toner attached to the magnetic brush on the brush roll 66. For example, with positively charged toner particles, the brush roll 66 may be negatively biased to a potential of about 200 volts with respect to ground, and the detoning roll may be negatively biased to a potential of about 10 volts with respect to brush roll 66.

In operation, magnetic brush bristles 86 are fully formed in the vicinity of sump exit magnet 80, and they contact and clean photoreceptor 12. Upon rotation to the area of trim magnet 78, magnetic brush bristles 86 are partially trimmed or removed by pickoff means 88 but they are renewed by carrier particles from sump 70 through exit means 90 and are again fully formed. Where the magnets are oriented rubber magnets, a magnetic field strength of between about 600 Gauss and about 700 Gauss on the magnetic brush cylinder provides satisfactory results. If the magnets are ceramic materials, a magnetic field strength of between about 1000 Gauss and about 1200 Gauss is likewise satisfactory in the cleaning operation. The magnetic field magnitude plays an important role for containment of cleaning carrier particles and their flow stability, both of which influence the function of the cleaning subsystem. In addition, the spacing latitude between the magnetic brush cylinder and the photoreceptor is reduced when employing the weaker rubber magnets. Further, it is preferred that the magnetic field profile be radial in the contact zone between the photoreceptor and the magnetic brush cylinder, i.e., normal for best results.

Due to the force of the magnets, the magnetic or magnetically-attractable carrier particles adhere to the periphery of the cylinder to form a magnetic brush which brushingly engages with the photoconductive surface and removes therefrom the residual toner particles. In accordance with this invention, a voltage of between about 50 volts and about 400 volts is applied to the cylinder of the cleaning apparatus to attract the residual toner particles from the photoconductive surface to the carrier particles magnetically entrained on the periphery of the cleaning apparatus cylinder. Thus, as the photoconductive surface is moved past the cleaning apparatus, it is contacted by the carrier particles in the form of a magnetic brush which remove substantially all of the residual toner particles from the photoconductive surface. To assist in removing the residual toner particles from the photoconductive surface, the magnetic brush cleaning apparatus is electrically biased to a positive polarity of between about 50 volts and about 400 volts, and preferably in the range of between about 75 volts and about 200 volts.

As the cleaning apparatus cylinder continues to rotate, the carrier beads pass in proximity to a toner reclaim roller which is electrically biased to a negative polarity of up to approximately 400 volts. The reclaim roller serves to attract the positively charged toner particles from the cleaning apparatus cylinder. The reclaim roller rotates in a direction counter to that of the magnetic brush cylinder and the toner particles attracted thereto are removed therefrom by a scraper balde and recovered. The toner reclaim roll may be made of any suitable non-magnetic material. Where the toner reclaim roll is made of metal such as stainless steel, a specific triboelectric charging relationship is important between the toner material and the metal of which the reclaim roll is made. That is, the toner material should be charged by the cleaning carrier particles to the same polarity as it is charged on contact with the reclaim roll. This relationship will enable efficient detoning of the magnetic cleaning brush. Conversely, where the relationship does not exist, extensive accumulation of toner material in the cleaning brush will occur. It is also important that the cleaning carrier particles triboelectrically charge the toner material to the same polarity as the developing carrier particles since, otherwise, material cntamination is possible between the development and cleaning subsystems.

Another factor affecting the properties of the cleaning subsystem of this invention is the charge of the residual toner material remaining on the photoreceptor surface after transfer of the developed image. This charge depends on all the prior electrostatographic rocess steps. As earlier indicated the cleaning subsystem will efficiently clean the residual toner material where the toner triboelectric charge is in a given range. Improved cleaning subsystem operation is also provided by use of a preclean corotron and a preclean erasure light. The role of the preclean corotron serves two purposes; i.e., it shifts the charge of the toner material, and reduces the range of the toner charge as well as influencing its distribution. The main role of the preclean light is to reduce the charge on the photoreceptor where the polarity of the charge and the nature of the photoreceptor conductivity make this possible.

Likewise, the efficiency of the cleaning subsystem of this invention is partially dependent on the process speed of the electrostatographic device. It has been found that both the toner reclaim roll and magnetic brush roll speeds should be approximately the same as that of the photoreceptor for best cleaning results. Generally, cleaning performance improves with increased magnetic brush roll speed; however, carrier particle life, carrier particle loss, and torque extracted from the drive favor the aforementioned brush roll speed. Satisfactory cleaning results have been obtained when the magnetic brush roll speed is between about 1 and 3 inches per second. However, a magnetic brush roll speed of between about 6 inches and about 15 inches per second is preferred in the present system for maximum photoreceptor cleaning efficiency.

As earlier indicated, the carrier particles employed in the cleaning system of this invention have electrically insulating properties and are capable of generating a triboelectric charge of at least about 15 microcoulombs per gram of toner material when contacted therewith. In addition, the carrier particles of this invention have a resistivity of more than about $10^{10}$ ohm-cm. The core particle may have an average diameter of from between about 30 microns and about 1,000 microns; however, it is preferred that the core particle have an average diameter of from between about 50 and about 200 microns to minimize toner impaction. Typically, optimum results are obtained when the core has an average particle diameter of about 100 microns.

In accordance with this invention, the core particle having magnetic or magnetically-attractable properties is preferably selected from iron, steel, ferrit, magnetite, nickel and mixtures thereof. The core particle is initially treated to provide it with a gritty, oxidized surface by conventional means such as by heat-treating in an oxidizing atmosphere.

After the core particle has been provided with an oxidized surface, it is coated with the afore-mentioned polyvinyl coated compositions. The polyvinyl acetal carrier particle coating compositions of this invention are formed by the well-known reaction between aldehydes and alcohols. Typically, the addition of one molecule of an alcohol to one molecule of an aldehyde produces a hemiacetal which is inherently unstable. However, hemiacetals are further reacted with another molecule of alcohol to form a stable acetal. In like fashion, polyvinyl acetals are prepared from aldehydes and polyvinyl alcohols. Polyvinyl alcohols are usually classified as partially hydrolyzed, that is, containing 15 to 30% of polyvinyl acetate groups, and completely hydrolyzed, or containing 0 to 5% of polyvinyl acetate groups. Both types, in various molecular weights, may be employed in producing commercial polyvinyl acetals.

In synthesis, the conditions of the acetal reaction and the concentration of the particular aldehyde and polyvinyl alcohol used are closely controlled to form polymers containing predetermined properties of hydroxyl groups, acetate groups, and acetal groups. The product obtained may be represented by the following generic structural formula wherein the proportions of A, B, and C are controlled and are randomly distributed along the molecule.

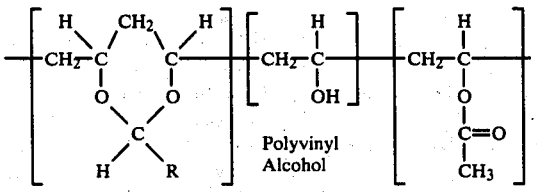

As earlier indicated, these materials are commercially available from Monsanto Plastics and resins, St. Louis, Mo. under various tradenames such as Butvar and Formvar. Number designations have been given for these commercial compositions and provide a summary indication of the molecular nature of the polymer. For example, the first digits of the Formvar resins indicate the viscosity of the polyvinyl acetate from which the resin was made. The second digits indicate the extent to which acetate groups have been removed by hydrolysis. For example, Formvar 12/85 is made from a polyvinyl acetate having a viscosity of 12.0 cps (viscosity of a benzene solution containing 86 grams of polyvinyl acetate per 1000 ml. of solution, measured at 20° C.). Approximately 85 percent of the acetate groups have been replaced with alcohol and formal groups.

Formvar resins can be described in general terms by their viscosity and solubility characteristics. Formvar 12/85 has the widest solubility range and is a medium viscosity type. All other types are more limited in solubility but are available in several viscosity ranges.

In Butvar resins, the acetate content is maintained at a low level and therefore exerts little influence on polymer properties. They are available in a variety of molecular weight ranges and types B-76 and B-79 have a lower hydroxyl content which permits broader solubility characteristics.

As a general rule, the substitution of butyral or formal groups for acetate groups results in a more hydrophobic polymer with a higher heat distortion temperature. At the same time, the polymer's toughness and adhesion to various substrates is considerably increased. The outstanding adhesion of the vinyl acetal resins is believed to be a result of their terpolymer constitution because each molecule presents the choice of three different functional groups to a surface and thus the probability of adhesion to a wide variety of substrates is increased substantially.

Although polyvinyl acetal resins normally are thermoplastic and soluble in a range of solvents, they may be cross-linked through heating and with a trace of mineral acid. Cross-linking is thought to be caused by transacetalization, but may also involve more complex mechanisms such as a reaction between acetate or hydroxyl groups on adjacent chains. Generally, cross-linking of the polyvinyl acetals is carried out by reaction with various thermosetting resins such as phenolics, epoxies, ureas, di-isocyanates and melamines. Incorporation of a small amount of vinyl acetal resin into thermosetting compositions will markedly improve toughness, flexibility and adhesion of the cured coating.

Vinyl acetal films are characterized by high resistance to aliphatic hydrocarbons, mineral, animal and vegetable oils (with the exception of castor and blown oils). They withstand strong alkalis but are subject to some attack by strong acids. However, when employed as components of cured coatings, their stability to acids as well as solvents and other chemicals is improved greatly. The vinyl acetals will withstand heating up to 200° F. for prolonged periods with little discoloration.

The carrier coating compositions of this invention may have a weight average molecular weight of between about 30,000 and about 270,000 and preferably between about 30,000 and about 45,000. Further, the coating compositions comprise from between about 1.0 and about 21.0 percent polyvinyl alcohol, from between about 0 and about 2.5 percent polyvinyl acetate, and from between about 80.0 and about 88.0 percent polyvinyl acetal, all percentages being by weight of the composition. In addition, these polymers have a yield tensile strength of between about 5800 and about 7800 psi, and an apparent modulus of elasticity of between about 280,000 and about 340,000 psi, as determined by ASTM method D638-58T. As to the thermal properties, the polymers have an apparent glass temperature (Tg) of between about 48° C. and about 68° C. as determined by ASTM method D1043-51.

In the preparation of the carrier materials of this invention, a coating solution is applied to the carrier core particles to provide them with a thin, substantially continuous coating of polyvinyl acetal. The polyvinyl acetal coating is applied to the carrier core particles by dissolving the coating material in a suitable solvent such as methyl ethyl ketone and dipping, tumbling or spraying the core particles with the coating solution. Preferably, a fluidized bed coating process is employed as typically a more uniform coating is provided to the carrier core particles. In such a coating process, the core particles are suspended and circulated in an upwardly flowing stream of heated air so that the particles are sprayed by the coating material in a first zone. Then, in a second zone, the particles settle through an air stream of lower air velocity where the solvent evaporates to form a thin solid coating on the particles. Successive layers of coating on the particles are obtained by recirculating them through the first and second zones of the fluid bed coating apparatus.

Any suitable coating weight of thickness of polyvinyl acetal may be employed to coat the carrier core particles. However, a coating having a thickness at least sufficient to form a substantially continuous film on the core particles is preferred because the carrier coating will then possess sufficient thickness to resist abrasion and minimize pinholes which may adversely affect the triboelectric properties of the coated carrier particles, and also in order that the desired triboelectric effect to the carrier is obtained and to maintain a sufficient negative charge on the carrier, the toner being charged positively in such an embodiment so as to allow development of negatively charged images to occur. Generally, for magnetic brush development the carrier coating may comprise from about 0.05 microns to about 3.0 microns in thickness on the carrier particle. Preferably, the coating should comprise from about 0.2 microns to about 0.7 microns in thickness on the carrier particle because maximum coating durability, toner impaction resistance, and copy quality are achieved. To achieve further variation in the properties of the final coated product, other additives such as plasticizers, reactive or non-reactive resins, dyes, pigments, conductive fillers such as carbon black, wetting agents and mixtures thereof may be mixed with the coating material.

Following application of the coating to the carrier particles of this invention, it has been found that, when the carrier particles are mixed with a conventional toner material such as one comprising a styrene/n-butyl methacrylate copolymer and carbon black, the triboelectric charge generated on the carrier particles is of a positive polarity. Since such a triboelectric charge is unsuitable to provide satisfactory developed image print density with a negatively charged photoconductive surface, it has been found that when these coated carrier particles are mixed with finely-divided toner particles containing a triboelectric charge control additive, the carrier particles of this invention unexpectedly obtain negative triboelectric charging values in the range of between about −15 to about −40 microcoulombs per gram of toner material. It was found that the triboelectric charging values of the thus coated carrier particles are excellent to provide developed copies having high image print density, high resolution and low background. In addition, the triboelectric charging values of the carrier particles remain stable over extended periods of milling.

Any suitable pigmented or dyed toner material may be employed with the carrier particles of this invention. Typical toner materials are gum copal, gum sandarac, resin, cumarone-indene resin, asphaltum, gilsonite, phenolformaldehyde resins, resin-modified phenolformaldehyde resins, methacrylic resins, polystyrene resins, epoxy resins, polyester resins, polyethylene resins, vinyl chloride resins, and copolymers or mixtures thereof. The particular toner material to be employed depends upon the separation of the toner particles from the carrier particles in the triboelectric series. However, it is preferred that the toner material comprise styrene and a lower alkyl acrylate or methacrylate such as methyl methacrylate, n-butyl methacrylate, and 2-ethyl hexyl methacrylate in the form of mixtures or copolymers and terepolymers thereof. Among the patents describing toner compositions are U.S. Pat. No. 2,659,670 issued to Copley; U.S. Pat. No. 2,753,308 issued to Landrigan; U.S. Pat. No. 3,070,342 issued to Insalaco; U.S. Reissue No. 25,136 to Carlson, and U.S. Pat. No. 2,788,288 issued to Rheinfrank et al. These toners generally have an average particle diameter in the range substantially 5 to 30 microns.

Any suitable pigment or dye may be employed as the colorant for the toner particles. Colorants for toners are well known and are, for example, carbon black, nigrosine dye, aniline blue, Calco Oil Blue, chrome yellow, ultramarine blue, Quinoline Yellow, methylene blue chloride, Monastral Blue, Malachite Green Oxalate, lampblack, Rose Bengal, Monastral Red, Sudan Black BN, and mixtures thereof. The pigment or dye should be present in the toner in a sufficient quantity to render it highly colored so that it will form a clearly visible image on a recording member.

Any suitable triboelectric charge controlling additive may be employed in the toner composition. Preferably, the additive will be one that enhances the positive triboelectric charging characteristics of the toner particles. Typical triboelectric charge controlling additives for this purpose include cetyl pyridinium chloride, cetyl pyridinium bromide, cetyl pyridinium tolsylate, cetyl alpha picolinium bromide, cetyl beta picolinium chloride, cetyl gamma picolinum bromide, n-lauryl, n-methyl morpholinium bromide, n,n-dimethyl n-cetyl hydrazinium chloride, and n,n-dimethyl n-cetyl hydrazinium tolsylate available from Hexcel Company; tetraethyl ammonium bromide available from Eastman Kodak Company; spirit soluble black dyes such as Nigrosine SSB, 3-lauramidopropyl trimethylammonium methylchloride, stearamidopropyl dimethyl B-hydroxyethyl ammonium dihydrogen phosphate, and stearamidopropyl dimethyl B-hydroxyethyl ammonium nitrate available from American Cyanamid Company; alkyl dimethyl benzyl ammonium chloride, cetyl dimethyl benzyl ammonium chloride, and stearyl dimethyl benzyl ammonium chloride available from Hexcel Company; distearyl dimethyl ammonium chloride available from Ashland Chemical Company; diisobutylcresoxylthoxyethyl dimethyl benzyl ammonium chloride available from Rohm and Haas Co.; and substituted imidazolines available from Ciba-Geigy Corporation.

Any suitable well-known electrophotosensitive material may be employed as the photoreceptor with the carrier particles of this invention. Well-known photoconductive materials are vitreous selenium, organic or inorganic photoconductors embedded in a non-photoconductive matrix, organic or inorganic photoconductors embedded in a photoconductive matrix, or the like. Representative patents in which photoconductive materials are disclosed include U.S. Pat. No. 2,803,542 issued to Ullrich, U.S. Pat. No. 2,970,906 issued to Bixby, U.S. Pat. No. 3,121,006 issued to Middleton, U.S. Pat. No. 3,121,007 issued to Middleton, and U.S. Pat. No. 3,151,982 issued to Corrsin.

The electrically insulating carrier particles of this invention provide a means for reducing the degrading effects of carrier-caused short circuits while carrying out development and cleaning functions for electrostatographic copying and/or duplicating devices. In addition, the fact that the carrier particles can be used for cleaning allows the cleaning system to use the same carrier particles as in the developer mixture and eliminates contaminating the developer material with cleaner particles and vice-versa. Moreover, the electrically insulating carrier particles of this invention may be used in magnetic brush cleaning systems with extremely good cleaning results while providing substantial savings in materials cost and maintainability over conventional conductive carrier cleaning systems.

In the following examples, the relative triboelectric values generated by contact of carrier particles with toner particles are measured by means of a Faraday Cage. This device comprises a stainless steel cylinder having a diameter of about 1 inch and a length of about 1 inch. A screen is positioned at each end of the cylinder; the screen openings are of such a size as to permit the toner particles to pass through the openings but prevent the carrier particles from making such passage. The Faraday Cage is weighed, charged with about 0.5 gram of the carrier particles and toner particles, reweighed, and connected to the input of a coulomb meter. Dry compressed air is then blow through the cylinder to drive all the toner particles from the carrier particles. As the electrostatically charged toner particles leave the Faraday Cage, the oppositely charged carrier particles cause an equal amount of electronic charge to flow from the Cage, through the coulomb meter, to ground. The coulomb meter measures this charge which is then taken to be the charge on the toner which was removed. Next, the cylinder is reweighed to determine the weight of the toner removed. The resulting data are used to calculate the toner concentration and the average charge to mass ratio of the toner. Since the triboelectric measurements are relative, the measurements should for comparative purposes be conducted under substantially identical conditions. Other suitable toners may be substituted for the toner composition used in the examples.

The following examples, other than the control example, further illustrate and compare methods of preparing and utilizing the carrier particles of the present invention in electrostatographic applications. Parts and percentages are by weight unless otherwise indicated.

EXAMPLE I

A control developer mixture was prepared by applying a coating composition to steel carrier particles having an average diameter of about 100 microns. The coating composition comprised a first layer of poly(vinyl chloride/vinyl acetate) commercially available as Exon 470 from Firestone Plastics Company, Pottstown, Pa. The coating composition was diluted with methyl ethyl ketone and applied to the carrier particles in a fluidized bed coating apparatus. About 0.3 parts by weight solids of the coating composition was applied per about 100 parts of the carrier particles. After removal of the solvent, the coated carrier particles were overcoated with a second layer comprising a vinyl chloride-chlorotrifluoroethylene copolymer commercially available as FPC 461 also from Firestone Plastics Company. The coating composition was diluted with methyl ethyl ketone and applied to the carrier particles in the fluidized bed coating apparatus. About 0.5 parts by weight solids of this coating composition were applied per about 100 parts of the carrier particles. After removal of the solvent, the coated carrier particles were dried by heating in an oven at about 75° C. for about 30 minutes to remove any residual solvent. The coated carrier particles were cooled to room temperature and screened to remove agglomerated particles. About 100 parts of the screened carrier particles were mixed with about 3 parts of finely divided toner particles to form a developer mixture. The composition of the toner particles comprised styrene, methyl methacrylate, 2-ethylhexyl methacrylate carbon black, and 3-lauramidopropyl trimethylammonium methylchloride. The developer mixture was roll-mill mixed and samples taken therefrom after about 1 hour for measurement of the triboelectric charge generated on the carrier particles as indicated above. The triboelectric value was found to be about −47.2 microcoulombs per gram of toner particles.

The developer mixture was placed in an electrostatographic copying device equipped with magnetic brush development and cleaning devices as described in FIG. 1 and FIG. 2. The photoreceptor was transported at a process speed of about ten inches per second. After charging, the photoreceptor was exposed to an original document and then formed electrostatic latent image developed with the aforedescribed developer mixture. The developed image was then transferred to a permanent substrate. Examination of the photoreceptor surface revealed residual toner deposits thereon.

The photoreceptor was then transported to the magnetic brush cleaning apparatus station wherein the aforedescribed carrier particles were employed as the cleaning particles. The cleaning carrier particles compacted pile height was maintained at between about 0.080 inches and about 0.120 inches. The magnetic brush roll was negatively biased to about 150 volts. The toner reclaim roll was made of stainless steel and negatively biased to about 20 volts. The spacing between the photoreceptor surface and the magnetic brush cleaning roll was about 0.060 inches, and that between the magnetic brush cleaning roll and the toner reclaim roll was also about 0.100 inches.

The magnetic brush cleaning roll was rotated counter to the direction of the photoreceptor surface at a process speed of about six inches per second. The toner reclaim roll was rotated counter to the direction of the magnetic brush cleaning roll at a process speed of about six inches per second. In addition, a thin, i.e., about 0.003 inch, metal blade was loaded against the toner reclaim roll to remove toner particles from the surface of the toner reclaim roll.

The preclean dicorotron was excited with about a one milliampere AC current at a frequency of about four kilohertz. The dicorotron shield was electrically biased to an average voltage of about 200 volts. The preclean erasure light employed was an incandescent 60 watt lamp.

After passage of the photoreceptor through the cleaning station, it was found that good residual toner particle cleaning performance was obtained employing the aforementioned cleaning particles and conditions. However, it was found that a maximum breakdown voltage of 1300 volts caused magnetic brush breakdown in a scale model text fixture for magnetic brush cleaning.

EXAMPLE II

A developer mixture was prepared by first applying a coating composition to steel carrier particles having an average diameter of about 100 microns. The coating composition comprised polyvinyl butyral commercially available as Butvar 79 from Monsanto Plastics and Resins, St. Louis, Mo. The coating composition was diluted with methyl ethyl ketone and applied to the carrier particles in a fluidized bed coating apparatus. About 0.8 parts by weight solids of the coating composition was applied per about 100 parts of the carrier particles. After removal of the solvent, the coated carrier particles were dried by heating in an oven at about 75° C. for about 30 minutes to remove any residual solvent. The coated carrier particles were cooled to room temperature and screened to remove agglomerated particles. About 100 parts of the screened carrier particles were mixed with about 3 parts of finely-divided toner particles to form a developer mixture. The composition of the toner particles was the same as in Example I. The developer mixture was roll-mill mixed and samples taken therefrom after about 1 hour for measurement of the triboelectric charge generated on the carrier particles as indicated above. The triboelectric value was found to be about −43.0 microcoulombs per gram of toner particles.

The developer mixture was placed in an electrostatographic copying device equipped with magnetic brush development and cleaning devices as described in FIG. 1 and FIG. 2. The photoreceptor was transported at a process speed of about ten inches per second. After charging, the photoreceptor was exposed to an original document and the formed electrostatic latent image developed with the aforedescribed developer mixture. The developed image was then transferred to a permanent substrate. Examination of the photoreceptor surface revealed residual toner deposits thereon.

The photoreceptor was then transported to the magnetic brush cleaning apparatus station wherein the aforedescribed carrier particles were employed as the cleaning particles. The cleaning carrier particles compacted pile height was maintained at between about 0.080 inches and about 0.120 inches. The magnetic brush roll was negatively biased to about 150 volts. The toner reclaim roll was made of stainless steel and negatively biased to about 20 volts. The spacing between the photoreceptor surface and the magnetic brush cleaning roll was about 0.060 inches, and that between the magnetic brush cleaning roll and the toner reclaim roll was also about 0.100 inches.

The magnetic brush cleaning roll was rotated counter to the direction of the photoreceptor surface at a process speed of about six inches per second. The toner reclaim roll was rotated counter to the direction of the magnetic brush cleaning roll at a process speed of about six inches per second. In addition, a thin, i.e., about 0.003 inch, metal blade was loaded against the toner reclaim roll to reclaim toner particles from the surface of the toner reclaim roll.

The preclean dicorotron was excited with about a one milliampere AC current at a frequency of about four kilohertz. The dicorotron shield was electrically biased to an average voltage of about 200 volts. The preclean erasure light employed was an incandescent 60 watt lamp.

After passage of the photoreceptor through the cleaning station, it was found that excellent residual toner particle cleaning performance was obtained employing the aforementioned cleaning particles and conditions. Unexpectedly, it was found that breakdown voltages of up to about 2400 volts could be obtained in a scale model test fixture for magnetic brush cleaning. At equivalent coating weights, the polyvinyl butyral coated carrier particles had substantially better electrical breakdown properties than the fluoropolymer coated carrier particles of Example I.

EXAMPLE III

A developer mixture was prepared by first applying a coating composition to steel carrier particles having an average diameter of about 100 microns. The coating composition comprised polyvinyl butyral commercially available as Butvar 79 from Monsanto Plastics and Resins, St. Louis, Missouri. The coating composition was diluted with methyl ethyl ketone and applied to the carrier particles in a fluidized bed coating apparatus. About 0.8 parts by weight solids of the coating composition was applied per about 100 parts of the carrier particles. After removal of the solvent, the coated carrier particles were dried by heating in an oven at about 75° C. for about 30 minutes to remove any residual solvent. The coated carrier particles were cooled to room temperature and screened to remove agglomerated particles. About 100 parts of the screened carrier particles were mixed with about 3 parts of finely-divided toner particles to form a developer mixture. The composition of the toner particles comprised about 87 parts of 65/35 styrene/n- butyl methacrylate copolymer, about 10 parts of carbon black commercially available as Raven 420 from Cities Service Company and about 3 parts of Nigrosine SSB commercially available from American Cyanamid Company. The developer mixture was roll-mill mixed and samples taken therefrom after about 1 hour for measurement of the triboelectric charge generated on the carrier particles as indicated above. The triboelectric value was found to be about −40.0 microcoulombs per gram of toner particles.

The developer mixture was placed in an electrostatographic copying device equipped with magnetic brush development and cleaning devices as described in FIG. 1 and FIG. 2. The photoreceptor was transported at a process speed of about ten inches per second. After charging, the photoreceptor was exposed to an original document and the formed electrostatic latent image developed with the aforedescribed developer mixture. The developed image was then transferred to a permanent substrate. Examination of the photoreceptor surface revealed residual toner deposits thereon.

The photoreceptor was then transported to the magnetic brush cleaning apparatus station wherein the aforedescribed carrier particles were employed as the cleaning particles. The cleaning carrier particles compacted pile height was maintained at between about 0.080 inches and about 0.120 inches. The magnetic brush roll was negatively biased to about 150 volts. The toner reclaim roll was made of stainless steel and negatively biased to about 20 volts. The spacing between the photoreceptor surface and the magnetic brush cleaning roll was about 0.060 inches, and that between the magnetic brush cleaning roll and the toner reclaim roll was also about 0.100 inches.

The magnetic brush cleaning roll was rotated counter to the direction of the photoreceptor surface at a process speed of about six inches per second. The toner reclaim roll was rotated counter to the direction of the magnetic brush cleaning roll at a process speed of about six inches per second. In addition, a thin, i.e., about 0.003 inch, metal blade was loaded against the toner reclaim roll to remove toner particles from the surface of the toner reclaim roll.

The preclean dicorotron was excited with about a one milliampere AC current at a frequency of about four kilohertz. The dicorotron shield was electrically biased to an average voltage of about 200 volts. The preclean erasure light employed was an incandescent 60 watt lamp.

After passage of the photoreceptor through the cleaning station, it was found that excellent residual toner particle cleaning performance was obtained employing the aforementioned cleaning particles and conditions. Unexpectedly, it was found that breakdown voltages of up to about 2400 volts could be obtained in a scale model test fixture for magnetic brush cleaning. At equivalent coating weights, the polyvinyl butyral coated carrier particles had substantially better electrical breakdown properties than the fluoropolymer coated carrier particles of Example I.

In summary, it has been shown that electrostatographic carrier particles coated with a polyvinyl acetal will provide carrier particles having negative triboelectric charging properties. These carrier particles possess such desirable negative triboelectric charging characteristics combined with excellent mechanical properties, low cost, and facile processability. The combination of strongly negative triboelectric charging properties and superior insulating properties obtained from polyvinyl coated coatings provides the carrier particles of this invention with uniquely desirable characteristics for use in electrostatographic developing and cleaning applications. Further, no post-treatment or fusing step is required in preparing the coated carrier particles of this invention such as with halogenated polymer coated carrier particles of the prior art.

Thus, although specific materials and conditions are set forth in the foregoing examples, these are merely intended as illustrations of the present invention. Various other suitable thermoplastic toner resin components, additives, colorants, and development processes such as those listed above may be substituted for those in the examples with similar results. Other materials may also be added to the toner or carrier to sensitize, synergize or otherwise improve other desirable properties of the system.

Other modifications of the present invention will occur to those skilled in the art upon a reading of the present disclosure. These are intended to be included within the scope of this invention.

We claim:

1. An improved magnetic brush cleaning system for removing residual toner particles from an imaging surface in an electrostatographic copying device, the cleaning system containing a magnetic brush roller positioned adjacent to the area of the imaging surface to be cleaned, a plurality of magnets located therein, a plurality of magnetic carrier particles adhering to the magnetic brush roller, a toner reclaim roller positioned adjacent to the path of the magnetic brush roller, allowing the carrier particles to contact the toner particles thereon, means for electrically biasing the magnetic brush roller to a voltage of between about 50 volts and about 400 volts to assist in attracting the residual toner particles from the imaging surface and onto the carrier particles;

and means for electrically biasing the toner reclaim roll to a negative polarity of up to about 400 volts to assist in removing the toner particles from the carrier particles, the improvement residing in the utilization of electrically insulating carrier particles having a resistivity of more than $10^{10}$ ohm-cm, and a triboelectric charge of at least about −15 microcouloms per gram, said carrier particles being comprised of a core having an average diameter of from between about 30 microns and about 1,000 microns, said core having an outer coating comprising a polyvinyl acetal.

2. A magnetic brush cleaning system in accordance with claim 1 wherein said photoreceptor, said carrier particles, and said toner reclaim roll all triboelectrically charge said toner particles to the same polarity.

3. A magnetic brush cleaning system in accordance with claim 1 wherein said carrier particles comprise a core having a gritty, oxidized surface.

4. A magnetic brush cleaning system in accordance with claim 1 wherein said carrier particles acquire a negative triboelectric charge and said toner particles acquire a positive triboelectric charge.

5. A magnetic brush cleaning system in accordance with claim 1 wherein said polyvinyl acetal comprises polyvinyl butyral.

6. A magnetic brush cleaning system in accordance with claim 1 wherein said polyvinyl acetal comprises polyvinyl formal.

7. A magnetic brush cleaning system in accordance with claim 1 wherein said polyvinyl acetal is present in an amount sufficient to form a substantially continuous film on said core.

8. A magnetic brush cleaning system in accordance with claim 1 wherein said core comprises a ferromagnetic material selected from the group consisting of iron, steel, ferrite, magnetite, nickel, and mixtures thereof.

9. An improved magnetic brush cleaning system in accordance with claim 1 wherein said outer coating for the carrier particles contains a polyvinyl acetal component, a polyvinyl alcohol component, and a polyvinyl acetate component, and is of the following formula

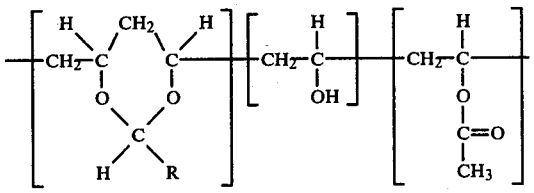

10. A magnetic brush cleaning system in accordance with claim 1 wherein said outer coating has a weight average molecular weight of between about 30,000 and 270,000.

* * * * *